US011401759B2

(12) United States Patent
Hobbs

(10) Patent No.: US 11,401,759 B2
(45) Date of Patent: Aug. 2, 2022

(54) HORIZONTAL DIRECTIONAL DRILLING SYSTEM AND METHOD OF OPERATING

(71) Applicant: Cable One, Inc., Phoenix, AZ (US)

(72) Inventor: Lincoln Kyle Hobbs, Norris City, IL (US)

(73) Assignee: CABLE ONE, INC., Phoenix, AZ (US)

( * ) Notice: Subject to any disclaimer, the term of this patent is extended or adjusted under 35 U.S.C. 154(b) by 183 days.

(21) Appl. No.: 16/733,696

(22) Filed: Jan. 3, 2020

(65) Prior Publication Data

US 2021/0207446 A1 Jul. 8, 2021

(51) Int. Cl.

| | |
|---|---|
| ***E21B 21/08*** | (2006.01) |
| ***E21B 7/04*** | (2006.01) |
| ***E21B 21/10*** | (2006.01) |
| ***E21B 21/06*** | (2006.01) |
| ***E21B 21/01*** | (2006.01) |

(52) U.S. Cl.

CPC ..... *E21B 21/08* (2013.01); *E21B 7/046* (2013.01); *E21B 21/01* (2013.01); *E21B 21/062* (2013.01); *E21B 21/10* (2013.01)

(58) Field of Classification Search

CPC ..... E21B 21/08; E21B 21/10; E21B 21/062; E21B 21/06; E21B 21/01; E21B 7/046; E21B 43/2607

See application file for complete search history.

(56) References Cited

U.S. PATENT DOCUMENTS

| | | | | |
|---|---|---|---|---|
| 3,011,567 | A | 12/1961 | Turner | |
| 5,411,104 | A | 5/1995 | Stanley | |
| 5,553,680 | A | 9/1996 | Hathaway | |
| 5,723,416 | A | 3/1998 | Liao | |
| 7,204,327 | B2 | 4/2007 | Livingstone | |
| 7,407,019 | B2 | 8/2008 | Kinder et al. | |
| 8,297,377 | B2 | 10/2012 | Zupanick | |
| 8,430,175 | B2 | 4/2013 | Calderoni et al. | |
| 10,240,412 | B2 | 3/2019 | Tooley | |
| 2014/0202702 | A1* | 7/2014 | Cobb | E21B 21/062 166/307 |
| 2017/0232407 | A1* | 8/2017 | Cobb | B01F 3/0865 166/312 |
| 2019/0078426 | A1* | 3/2019 | Zheng | E21B 33/063 |

FOREIGN PATENT DOCUMENTS

| | | | |
|---|---|---|---|
| WO | 2017050334 | A2 | 3/2017 |
| WO | 2018004714 | A1 | 1/2018 |

* cited by examiner

*Primary Examiner* — Tara Schimpf
*Assistant Examiner* — Yanick A Akaragwe
(74) *Attorney, Agent, or Firm* — Armstrong Teasdale LLP

(57) ABSTRACT

A horizontal directional drilling system is provided. The system includes a first tank for containing fluid therein, a second tank for containing fluid therein, a manifold comprising at least one inlet port and at least one outlet port, a feed line extending from the manifold, and a valve system configured to control fluid flow to and from the manifold. The valve system is configured to provide selective flow communication to the manifold from one of the first tank or the second tank through the at least one inlet port, and is configured to provide selective flow communication from the manifold to one of the first tank, the second tank, or the feed line through the at least one outlet port.

19 Claims, 2 Drawing Sheets

HORIZONTAL DIRECTIONAL DRILLING SYSTEM AND METHOD OF OPERATING

BACKGROUND

The field of the present disclosure relates generally to horizontal directional drilling and, more specifically, to a directional drilling system having enhanced mixing and operational versatility.

Horizontal directional drilling (HDD) is a process that enables the formation of horizontal underground bore holes for use in the installation of underground utilities and/or communication lines. Many known HDD systems include a drilling platform that receives drilling fluid from a tank on a fluid supply platform. The platforms are both located at a drilling site on an above-ground surface. A drill string is attached to, and extends from, the drilling platform, and a drilling tool is located at a distal end of the drill string. The underground bore hole is formed by drilling a hole into the ground at an oblique angle relative to the ground surface until the drilling tool reaches a desired depth. The drilling tool is then directed in a substantially horizontal direction to facilitate forming the horizontal underground bore hole.

Throughout the drilling process, drilling fluid is channeled through the drill string and discharged within the bore hole for cooling, lubrication, and/or cutting removal purposes. Based on the ground conditions in which the drilling is to occur, the drilling fluid may be formed on-site within the tank from a mixture of water and a chemical additive. For example, the tank may be filled with water and then delivered to the drilling site, and the chemical additive mixed with the water within the tank at the drilling site. However, many known HDD systems include only a single tank on the platform such that, once formed within the tank, a drilling fluid mixture having a predetermined concentration of chemical additive must be used throughout the drilling process. In the event it is desired to use a different drilling fluid mixture, additional water may be provided to the tank from another tank on a separate platform, and the mixture formed as desired. Alternatively, the drilling platform may be detached from the first platform and attached to a second platform that contains a different drilling fluid mixture (e.g., a different chemical additive concentration and/or type of chemical additive). However, such operations can be time-consuming and laborious tasks, and locating multiple platforms at a drilling site facilitates increasing equipment and maintenance costs for a drilling operator.

BRIEF DESCRIPTION

In one aspect, a horizontal directional drilling system is provided. The system includes a first tank for containing fluid therein, a second tank for containing fluid therein, a manifold comprising at least one inlet port and at least one outlet port, a feed line extending from the manifold, and a valve system configured to control fluid flow to and from the manifold. The valve system is configured to provide selective flow communication to the manifold from one of the first tank or the second tank through the at least one inlet port, and is configured to provide selective flow communication from the manifold to one of the first tank, the second tank, or the feed line through the at least one outlet port.

In another aspect, a horizontal directional drilling system is provided. The system includes a drilling platform and a fluid delivery system. The fluid delivery system includes first tank for containing fluid therein, a second tank for containing fluid therein, a manifold comprising at least one inlet port and at least one outlet port, and a valve system configured to control fluid flow to and from the manifold. The valve system is configured to provide selective flow communication to the manifold from one of the first tank or the second tank through the at least one inlet port, and is configured to provide selective flow communication from the manifold to one of the first tank, the second tank, or the drilling platform through the at least one outlet port.

In yet another aspect, a method of operating a horizontal drilling system is provided. The method includes channeling fluid from one of a first tank or a second tank to a manifold, providing, by a valve system, selective flow communication from the manifold through one of a plurality of outlet ports defined in the manifold, and discharging the fluid from the manifold through either a first outlet port or a second outlet port of the plurality of outlet ports. The first outlet port is in flow communication with a drilling platform of the horizontal directional drilling system.

DETAILED DESCRIPTION

Figure 1:
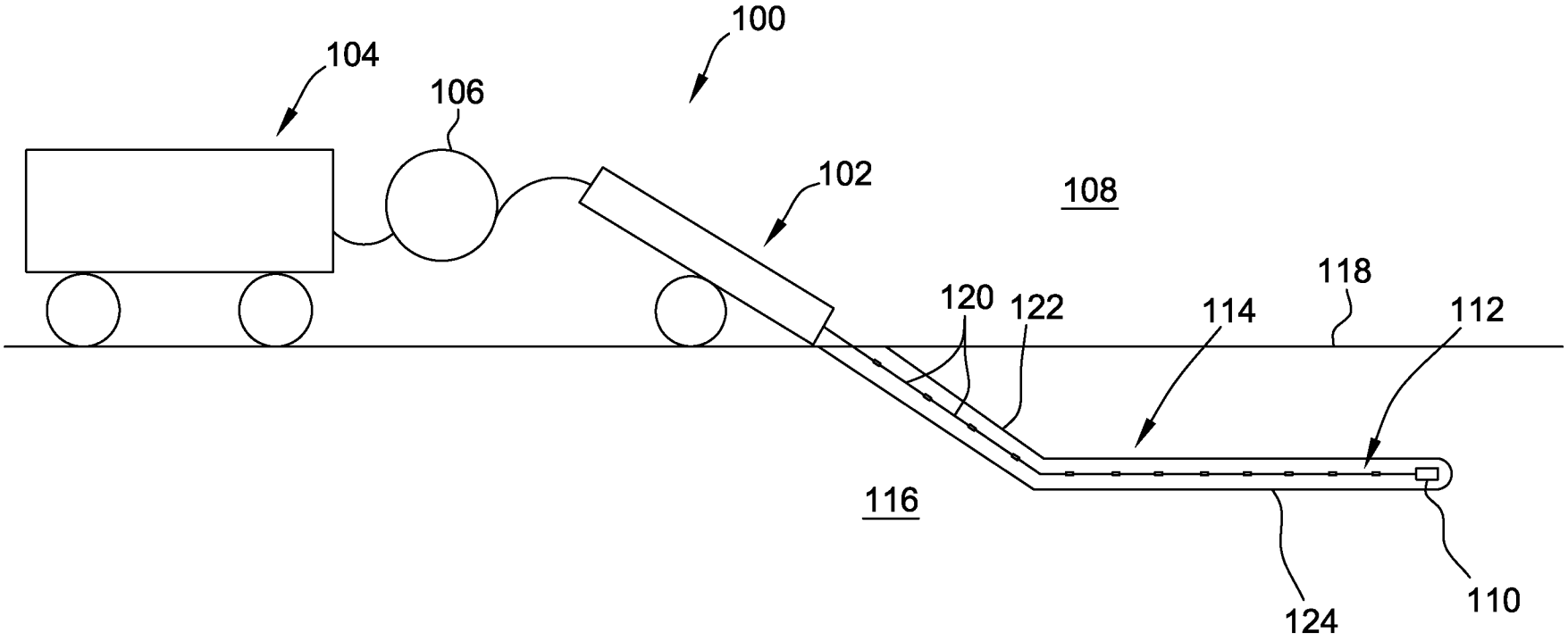
FIG. 1 is a side view above-ground and below-ground illustration of an example horizontal directional drilling system.

The following detailed description illustrates the disclosure by way of example and not by way of limitation. The description enables one skilled in the art to make and use the disclosure, describes several embodiments, adaptations, variations, alternatives, and use of the disclosure, including what is presently believed to be the best mode of carrying out the disclosure.

Embodiments of the present disclosure relate to a directional drilling system having enhanced mixing and operational versatility. The system described herein includes a mobile platform having multiple fluid tanks fluidly connected to each other, and to other components of the drilling system, in a manner that enables fluid to be circulated within the system to achieve a multitude of operational capabilities in a simplified and efficient manner. For example, the system includes a manifold that controls fluid flow within the system, such as from the fluid tanks to a drilling assembly and/or between the individual fluid tanks.

In one embodiment, a first tank and a second tank on the mobile platform may contain different fluids. For example, the tanks may be filled with water at a filling station and then delivered to a drilling site on the mobile platform. At least some known drilling processes use a drilling fluid provided from the mobile platform, wherein the drilling fluid is formed from a mixture of water and an additive. In one embodiment, a first additive may be added to the first tank and a second additive added to the second tank, or different amounts of the same additive added to the first and second tanks, thereby facilitating the generation of different drilling fluids. The drilling fluids may have differing operational capabilities and be tailored for use based on ground conditions in which drilling is taking place, for example. The manifold enables the different drilling fluids to be provided to the drilling assembly in an efficient and seamless manner, which enhances the operational versatility of the platform.

Alternatively, an additive may be added only to the first tank such that the first tank contains the drilling fluid and the second tank contains water, thereby maintaining separation between one "clean" tank and one "dirty" tank on the platform. In such an embodiment, controlling fluid flow between the first and second tanks provides the ability to replenish the fluid level in the first tank with water from the second tank. Replenishing the fluid level in the first tank with water from the second tank facilitates continuation of the drilling process, provides the ability to dilute the drilling fluid in the first tank with water from the second tank, and/or enables the generation of an entirely different drilling fluid (i.e., containing a different additive or different additive concentration) within the first tank after the original drilling fluid contained therein has been expended, for example. As such, the systems described herein facilitate providing a drilling operator with the ability to generate drilling fluid quickly, efficiently, and as-needed for a particular drilling operation.

Referring now to the drawings, FIG. 1 is a side view above-ground and below-ground illustration of an example horizontal directional drilling (HDD) system 100. In the example embodiment, HDD system 100 includes a drilling platform 102, a fluid delivery system 104, and a hose reel assembly 106 that fluidly connects drilling platform 102 to fluid delivery system 104. HDD system 100 is located at an above-ground level 108. Drilling platform 102 includes a drilling head 110 and a drill string 112 that extends from drilling platform 102 for creating an underground bore hole 114 within a subterranean level 116 located below above-ground level 108 and a ground level 118. Drill string 112 is formed from a plurality of drill string segments 120 that are serially connected to progressively increase the length of drill string 112 as the length of bore hole 114 increases.

As will be explained in more detail below, drilling platform 102 performs a drilling operation as drilling fluid is provided from fluid delivery system 104 and discharged within bore hole 114. For example, in operation, the drilling fluid is channeled from fluid delivery system 104, through hose reel assembly 106, and through drill string 112 to be discharged from drilling head 110. Drilling head 110 is initially directed to form a first bore hole section 122 within subterranean level 116 that is oriented obliquely relative to ground level 118. First bore hole section 122 is formed until drilling head 110 reaches a predetermined depth within subterranean level 116. The orientation of drilling head 110 is then adjusted to facilitate forming a second bore hole section 124 that is oriented generally parallel with ground level 118. Throughout the drilling operation, the drilling fluid discharged from drilling head 110 for cooling and lubrication of drilling head 110, and/or for flushing cuttings from within bore hole 114.

Figure 2:
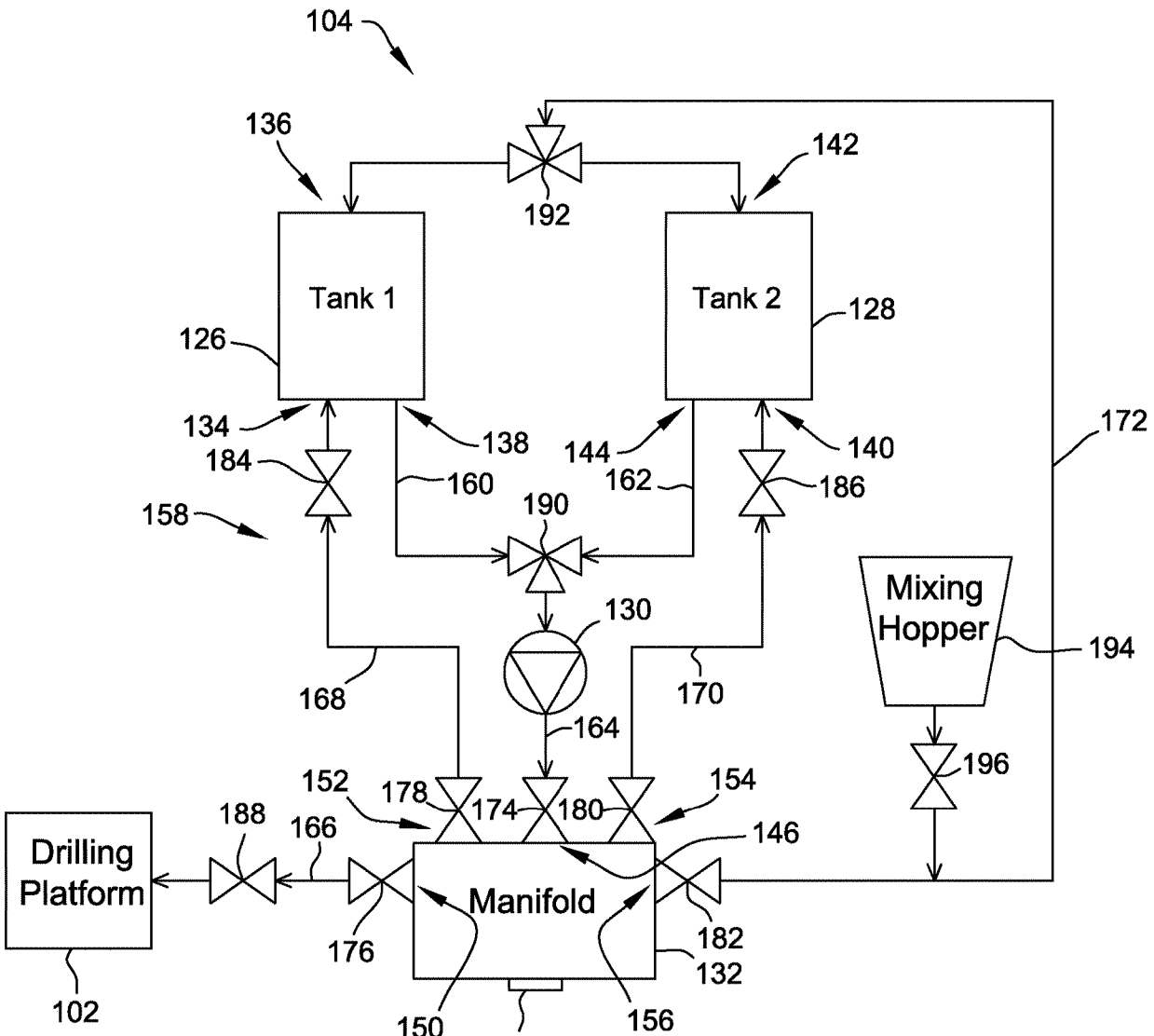
FIG. 2 is a schematic diagram illustrating an example fluid delivery system that may be used in the horizontal directional drilling system shown in FIG. 1.

FIG. 2 is a schematic diagram illustrating an example fluid delivery system 104 that may be used in the HDD system 100 (shown in FIG. 1). In the example embodiment, fluid delivery system 104 includes a first tank 126, a second tank 128, a pump 130, and a manifold 132. First tank 126 and second tank 128 are both designed to contain fluid therein, such as water or drilling fluid (i.e., a mixture of water and a drilling additive), as will be explained in more detail below. First tank 126 includes a first inlet port 134, a second inlet port 136, and a first outlet port 138. Second tank 128 includes a first inlet port 140, a second inlet port 142, and a first outlet port 144. Manifold 132 includes at least one inlet port and at least one outlet port. In the example embodiment, manifold 132 includes a first inlet port 146, an air inlet port 148, a first outlet port 150, a second outlet port 152, a third outlet port 154, and a fourth outlet port 156. Fluid delivery system 104 also includes a valve system 158 that controls fluid flow to and from manifold 132. It should be understood that any combination of ports and valves may be used to control fluid flow to and from manifold 132 as described herein.

A first discharge line 160 is coupled between first tank 126 and pump 130, a second discharge line 162 is coupled between second tank 128 and pump 130, and a third discharge line 164 is coupled between pump 130 and first inlet port 146. First discharge line 160 provides flow communication from first tank 126 to pump 130, second discharge line 162 provides flow communication from second tank 128 to pump 130, and third discharge line 164 provides flow communication from pump 130 to manifold 132. A feed line 166 (e.g., hose reel assembly 106 (shown in FIG. 1)) is coupled between first outlet port 150 and drilling platform 102. A first recirculation line 168 is coupled between second outlet port 152 and first inlet port 134 of first tank 126, and a second recirculation line 170 is coupled between third outlet port 154 and first inlet port 134 of second tank 128. First recirculation line 168 provides flow communication from manifold 132 to first tank 126, and second recirculation line 170 provides flow communication from manifold 132 to second tank 128. A third recirculation line 172 extends from manifold 132 for providing flow communication from manifold to one or first tank 126 or second tank 128.

In the example embodiment, valve system 158 includes a first valve 174, a second valve 176, a third valve 178, a fourth valve 180, and a fifth valve 182 coupled to manifold 132. First valve 174 is at first inlet port 146, second valve 176 is at first outlet port 150, third valve 178 is at second outlet port 152, fourth valve 180 is at third outlet port 154, and fifth valve 182 is at fourth outlet port 156. Valve system 158 also includes a sixth valve 184 coupled along first recirculation line 168, a seventh valve 186 coupled along second recirculation line 170, an eighth valve 188 coupled along feed line 166. Valves 184, 186, and 188 provide supplemental and/or redundant fluid control for fluid discharged from manifold 132. Valve system 158 also includes a first three-way valve 190 and a second three-way valve 192. First three-way valve 190 controls fluid flow from first tank 126 and from second tank 128. For example, first three-way valve 190 is fluidly coupled to first discharge line 160 and second discharge line 162 for selectively channeling fluid received from one of first tank 126 or second tank 128 to pump 130. Second three-way valve 192 controls fluid flow from manifold 132 to one of first tank 126 or second tank 128. For example, second three-way valve 192 is fluidly coupled to third recirculation line 172 and facilitates selectively channeling fluid within third recirculation line 172 to second inlet port 136 of first tank 126, or to second inlet port 142 of second tank 128.

In the example embodiment, fluid delivery system 104 includes a mixing hopper 194 in flow communication with third recirculation line 172. Mixing hopper 194 contains a drilling additive therein in powder form. A ninth valve 196 is coupled between mixing hopper 194 and third recirculation line 172. Ninth valve 196 controls the metering of powderized drilling additive to be injected into third recirculation line 172, as will be described in more detail below.

Example powderized drilling additives include, but are not limited to a mixture of bentonite clay and silica, and a crystallized viscosifier and lubricant additive. Example liquid drilling additives include, but are not limited to, water-based polymer materials.

In one embodiment, first tank 126 and second tank 128 initially contain fluid therein, such as water, and a liquefied drilling additive may be added manually to one or both of first tank 126 and second tank 128 to form drilling fluid. When the drilling additive is added only to first tank 126, for example, fluid delivery system 104 is operable to provide the drilling fluid to drilling platform 102. For example, in operation, first three-way valve 190 is actuated to channel the drilling fluid within first tank 126 to pump 130. First valve 174, second valve 176, third valve 178, and eighth valve 188 are opened, and fourth valve 180, and fifth valve 182 are closed. Accordingly, drilling fluid discharged from pump 130 is received at manifold 132 and discharged through first outlet port 150 of manifold 132 for channeling towards drilling platform.

As noted above, a drilling operator may desire to mix drilling fluid in only one fluid tank while keeping the other fluid tank "clean" (i.e., water-filled). In such a scenario, fluid from second tank 128 may be channeled to first tank 126 to facilitate replenishing its fluid supply. For example, in operation, first three-way valve 190 is actuated to channel the water within second tank 128 to pump 130. First valve 174, third valve 178, and sixth valve 184 are opened, and second valve 176, fourth valve 180, and fifth valve 182 are closed. Accordingly, water discharged from pump 130 is received at manifold 132 and discharged through second outlet port 152 for channeling towards first tank 126. After first tank 126 is at least partially refilled, additional drilling additive may be added to first tank 126 and the drilling fluid resulting therefrom provided to drilling platform 102 as described above to facilitate continuation of the drilling operation.

While the above embodiments were described in the context of providing drilling fluid from first tank 126 and replenishing the fluid content of first tank 126, it should be understood that fluid delivery system 104 is capable of providing drilling fluid from second tank 128 and replenishing the fluid content of second tank 128 with fluid from first tank 126.

In an alternative embodiment, first tank 126 and second tank 128 initially contain fluid therein, such as water, and the drilling fluid is formed by mixing with the drilling additive contained within mixing hopper 194. In such an embodiment, fluid is channeled from first tank 126 to manifold 132. At manifold 132, fifth valve 182 is opened, and second valve 176, third valve 178, and fourth valve 180 are closed. In addition, ninth valve 196 is opened to facilitate providing the drilling additive within third recirculation line 172. After a desired amount of drilling additive has been injected into third recirculation line 172, valve system 158 is actuated to facilitate substantially uniformly distributing the drilling additive within the water. For example, valves 174, 178, and 184 are opened, and valves 176, 180, and 182 are closed. Valve 190 is actuated to channel fluid from first tank 126 towards manifold, which is then recirculated back into first tank 126, thereby agitating the fluid contained therein and facilitating the mixing. The drilling fluid may then be channeled to drilling platform 102 as described above.

While the above embodiments were described in the context of mixing fluid from first tank 126 with the drilling additive from mixing hopper 194, it should be understood that fluid delivery system 104 is capable of mixing fluid from second tank 128 with the drilling additive from mixing hopper 194.

After drilling operations and fluid circulation is ended, residual fluid may remain within fluid delivery system 104. Accordingly, a source of purge air, such as a compressor, may be fluidly connected to manifold 132 at air inlet port 148. In such a scenario, valve system 158 is opened and purge air is channeled into manifold 132 via air inlet port 148 at a pressure that facilitates discharging the residual fluid from manifold 132, fluid lines, and the like to facilitate enhancing the service life and usability of the components of fluid delivery system 104.

This written description uses examples to disclose various implementations, including the best mode, and also to enable any person skilled in the art to practice the various implementations, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A horizontal directional drilling system comprising: a first tank for containing fluid used for drilling; a second tank for containing fluid used for drilling; a manifold comprising at least one inlet port, a first outlet port, and a second outlet port; a feed line extending from the manifold; and a valve system configured to control fluid flow to and from the manifold, wherein the valve system is configured to provide selective flow communication to the manifold from one of the first tank or the second tank through the at least one inlet port, is configured to provide selective flow communication from the manifold to the feed line through the first outlet port, and is configured to provide selective flow communication from the first tank to the second tank, or from the second tank to the first tank, through the second outlet port.

2. The system in accordance with claim 1 further comprising a pump coupled between the first tank and the manifold, and between the second tank and the at least one inlet port of the manifold, the valve system comprising a first three-way valve configured to selectively channel the fluid from one of the first tank or the second tank to the pump.

3. The system in accordance with claim 1 further comprising a drilling platform, wherein the feed line is fluidly coupled between the first outlet port and the drilling platform.

4. The system in accordance with claim 3 further comprising:

a first recirculation line coupled between a third outlet port of the manifold and the first tank; and a second recirculation line coupled between a fourth outlet port of the manifold and the second tank, wherein the valve system comprises a first valve at the first outlet port, a second valve at the second outlet port, and a third valve at the third outlet port.

5. The system in accordance with claim 1 further comprising:

a third recirculation line extending from the second outlet port, the third recirculation line configured to receive fluid channeled from the manifold; and a mixing hopper for containing a drilling additive therein, the mixing hopper in flow communication with the third recirculation line for mixing the drilling additive with the fluid to form a drilling fluid.

6. The system in accordance with claim 5, wherein the valve system comprises a second three-way valve coupled along the third recirculation line to selectively channel the drilling fluid to one of the first tank or the second tank.

7. The system in accordance with claim 5, wherein the valve system comprises a fourth valve at the fourth outlet port.

8. The system in accordance with claim 1, wherein the at least one inlet port comprises an air inlet port configured to receive a flow of purge air.

9. A horizontal directional drilling system comprising:

a drilling platform;

a fluid delivery system comprising:

first tank for containing fluid therein;

a second tank for containing fluid therein;

a manifold comprising at least one inlet port, a first outlet port, and a second outlet port; and a valve system configured to control fluid flow to and from the manifold, wherein the valve system is configured to provide selective flow communication to the manifold from one of the first tank or the second tank through the at least one inlet port, is configured to provide selective flow communication from the manifold to the drilling platform through the first outlet port, and is configured to provide selective flow communication from the first tank to the second tank, or from the second tank to the first tank, through the second outlet port.

10. The system in accordance with claim 9 further comprising a pump coupled between the first tank and the manifold, and between the second tank and the at least one inlet port of the manifold, the valve system comprising a first three-way valve configured to selectively channel the fluid from one of the first tank or the second tank to the pump.

11. The system in accordance with claim 9 further comprising a mixing hopper coupled in flow communication between of the manifold and the first and second tanks, the mixing hopper configured to mix a drilling additive contained therein with the fluid channeled from the manifold to form a drilling fluid to be provided to one of the first tank or the second tank.

12. The system in accordance with claim 11, wherein the valve system comprises a second three-way valve coupled between the mixing hopper and the first and second tanks to selectively channel the drilling fluid to one of the first tank or the second tank.

13. The system in accordance with claim 9 further comprising a hose reel assembly fluidly coupled between the fluid delivery system and the drilling platform, the hose reel assembly coupled to the first outlet port.

14. The system in accordance with claim 13 further comprising:

a first recirculation line coupled between a third outlet port of the manifold and the first tank; and a second recirculation line coupled between a fourth outlet port of the manifold and the second tank, wherein the valve system comprises a first valve at the first outlet port, a second valve at the second outlet port, and a third valve at the third outlet port.

15. A method of operating a horizontal drilling system, the method comprising:

channeling fluid from one of a first tank or a second tank to a manifold;

providing, by a valve system, selective flow communication from the manifold through one of a plurality of outlet ports defined in the manifold;

selectively discharging the fluid from the manifold through a first outlet port, of the plurality of outlet ports, wherein the first outlet port is in flow communication with a drilling platform of the horizontal directional drilling system, selectively discharging the fluid from the manifold through a second outlet port, of the plurality of outlet ports, wherein the second outlet port is in flow communication with at least one of the first tank or the second tank; and selectively channeling the fluid from the first tank to the second tank, or from the second tank to the first tank, through the manifold.

16. The method in accordance with claim 15, wherein discharging the fluid comprises:

discharging the fluid from the manifold through the second outlet port for mixing with a drilling additive to form a drilling fluid; and channeling the drilling fluid to one of the first tank or the second tank.

17. The method in accordance with claim 16, wherein channeling the drilling fluid comprises channeling the drilling fluid towards a three-way valve that provides selective flow communication to one of the first tank or the second tank from the manifold.

18. The method in accordance with claim 16 further comprising mixing the fluid discharged from the manifold with the drilling additive discharged from a mixing hopper.

19. The method in accordance with claim 15, wherein channeling fluid from one of a first tank or a second tank comprises channeling the fluid from the first tank and the second tank to a single pump.

* * * * *